US010408577B2

(12) United States Patent
Pepka

(10) Patent No.: US 10,408,577 B2
(45) Date of Patent: Sep. 10, 2019

(54) RESILIENTLY MOUNTED ARMOR PANEL

(71) Applicant: Renton Coil Spring Company, Renton, WA (US)

(72) Inventor: Charles F. Pepka, Renton, WA (US)

(73) Assignee: RENTON COIL SPRING COMPANY, Renton, WA (US)

( * ) Notice: Subject to any disclaimer, the term of this patent is extended or adjusted under 35 U.S.C. 154(b) by 26 days.

(21) Appl. No.: 15/692,834

(22) Filed: Aug. 31, 2017

(65) Prior Publication Data

US 2018/0010891 A1 Jan. 11, 2018

Related U.S. Application Data

(62) Division of application No. 13/691,406, filed on Nov. 30, 2012, now abandoned.

(51) Int. Cl.

| | |
|---|---|
| ***F41H 7/04*** | (2006.01) |
| ***F41H 5/007*** | (2006.01) |
| ***F41H 5/02*** | (2006.01) |
| ***F41H 5/013*** | (2006.01) |
| ***F41H 5/04*** | (2006.01) |

(52) U.S. Cl.

CPC ..... *F41H 7/04* (2013.01); *F41H 5/007* (2013.01); *F41H 5/013* (2013.01); *F41H 5/023* (2013.01); *F41H 5/0421* (2013.01); *F41H 5/0428* (2013.01); *F41H 5/0457* (2013.01)

(58) Field of Classification Search

CPC . F41H 5/00; F41H 5/007; F41H 5/013; F14H 7/046

USPC ..... 296/187.07; 89/36.01, 36.02, 36.04, 89/36.05, 36.07, 36.08, 36.11, 36.12

See application file for complete search history.

(56) References Cited

U.S. PATENT DOCUMENTS

| | | | |
|---|---|---|---|
| 1,014,510 | A | 5/1911 | Papendry |
| 1,236,033 | A | 8/1917 | Almengual |
| 1,287,910 | A | 12/1918 | De Rosa |
| 1,294,920 | A | 3/1919 | Lemiszczak |
| 1,811,987 | A | 6/1931 | Wales |
| 2,084,320 | A | 6/1937 | Coleman |

(Continued)

FOREIGN PATENT DOCUMENTS

| | | | |
|---|---|---|---|
| CN | 2489142 | Y | 5/2002 |
| CN | 2767316 | Y | 3/2006 |

(Continued)

OTHER PUBLICATIONS

The Application of New Technology to Aluminum Armor Systems; pp. 3; Dated Mar. 25, 2015.

(Continued)

*Primary Examiner* — Hilary L Gutman

(74) *Attorney, Agent, or Firm* — Lowe Graham Jones PLLC

(57) ABSTRACT

An armor assembly having an armor panel, a base plate, and a resilient member coupled between the armor panel and the base plate is disclosed. An impact blast or projectile will strike the armor assembly and deflect the armor panel and the resilient member. The resilient member and armor panel absorb sufficient energy from the impact blast or projectile to prevent harm to underlying structures. The resilient member can be a spring or a solid member having a desired spring coefficient to protect against a certain impact load.

27 Claims, 5 Drawing Sheets

(56) References Cited

U.S. PATENT DOCUMENTS

| | | | | |
|---|---|---|---|---|
| 2,322,879 | A | 6/1943 | Piron | |
| 2,380,393 | A | 7/1945 | Berg | |
| 2,575,311 | A | 11/1951 | Barry et al. | |
| 2,605,099 | A * | 7/1952 | Brown | F16F 3/12 138/131 |
| 3,254,899 | A | 6/1966 | Voorhies | |
| 3,263,728 | A | 8/1966 | Lynch | |
| 3,331,083 | A | 7/1967 | Holly | |
| 3,831,921 | A | 8/1974 | Negado | |
| 4,004,493 | A | 1/1977 | Costanza | |
| 4,077,619 | A | 3/1978 | Borlinghaus | |
| 4,111,407 | A | 9/1978 | Stager | |
| 4,120,486 | A | 10/1978 | Borlinghaus | |
| 4,352,316 | A | 10/1982 | Medlin | |
| 4,779,850 | A * | 10/1988 | Paton | B60G 11/54 267/152 |
| 4,817,921 | A * | 4/1989 | Stevenson | B60G 11/52 248/621 |
| 4,841,838 | A | 6/1989 | Scully et al. | |
| 4,886,255 | A * | 12/1989 | Paton | B60G 15/04 267/205 |
| 4,948,673 | A | 8/1990 | Goeury | |
| 4,957,277 | A * | 9/1990 | Paton | F16F 1/422 267/152 |
| 5,007,326 | A | 4/1991 | Gooch, Jr. et al. | |
| 5,083,515 | A | 1/1992 | Seksaria et al. | |
| 5,340,633 | A | 8/1994 | Van Der Loo et al. | |
| 5,364,086 | A * | 11/1994 | Paton | B60G 11/465 248/562 |
| 5,823,518 | A | 10/1998 | Nagamitsu et al. | |
| 5,875,567 | A | 3/1999 | Bayley | |
| 5,878,998 | A | 3/1999 | Hsieh | |
| 7,128,312 | B2 * | 10/2006 | Salis | B61F 5/142 267/141.1 |
| 7,883,135 | B2 | 2/2011 | Ravid et al. | |
| 8,114,474 | B1 | 2/2012 | Dudt et al. | |
| 9,377,073 | B2 * | 6/2016 | Feng | F16F 3/12 |
| 2003/0104739 | A1 | 6/2003 | Jenkins et al. | |
| 2004/0140283 | A1 * | 7/2004 | Salis | B61F 5/142 213/40 R |
| 2006/0065111 | A1 | 3/2006 | Henry | |
| 2007/0068755 | A1 | 3/2007 | Hawkins et al. | |
| 2007/0116939 | A1 | 5/2007 | Benitsch et al. | |
| 2009/0142557 | A1 | 6/2009 | Hardin | |
| 2009/0169855 | A1 | 7/2009 | Tunis | |
| 2009/0214812 | A1 | 8/2009 | Bartus et al. | |
| 2012/0055324 | A1 | 3/2012 | Pepka | |
| 2012/0186424 | A1 | 7/2012 | Tunis et al. | |
| 2012/0286462 | A1 | 11/2012 | Pepka | |

FOREIGN PATENT DOCUMENTS

| | | | |
|---|---|---|---|
| DE | 2424098 | A1 | 11/1975 |
| DE | 19842629 | C1 | 3/2000 |
| DK | 2375214 | T3 | 6/2013 |
| EP | 1947414 | A1 | 7/2008 |
| FR | 888358 | A | 12/1943 |
| JP | 2002527705 | A | 8/2002 |
| WO | 2004084664 | A2 | 10/2004 |
| WO | 2004109214 | A2 | 12/2004 |

OTHER PUBLICATIONS

Summit Racing Equipment Coil Over Springs; pp. 2; Dated Oct. 21, 2015.

century Spring Corporation Compression Spring Online Catalog; pp. 217.

Ballistic Testing of Commercial Aluminum; pp. 8.

Advanced Cast Aluminum Alloys; pp. 9; Dated 2009.

* cited by examiner

RESILIENTLY MOUNTED ARMOR PANEL

PRIORITY CLAIM

This patent application is a Divisional of U.S. patent application Ser. No. 13/691,406, entitled RESILIENTLY MOUNTED ARMOR PANEL, filed on Nov. 30, 2012. The contents of which are hereby incorporated by reference.

FIELD OF THE INVENTION

This invention relates generally to resiliently mounted armor panels and more specifically to protective armor panels to absorb projectiles and projectile energy.

BACKGROUND OF THE INVENTION

Armor and armor cladding for vehicles, buildings, and installations has been used for many years to provide protection from various explosive devices and projectiles that can cause bodily harm or harm to objects such as machinery or computers. Armor is used for projection from projectiles such as bullets, sharp and/or pointed objects such as knives and swords, blasts and shrapnel generated by explosive devices, and the like.

With regard to body armor, protective armor is either rigid and heavy (such as ceramic plates), or flexible and lightweight (such as that fabricated from aramid fibers, for example KEVLAR® brand materials). However, there is often a tradeoff in that armor that is more flexible and lightweight often provides less protection than armor that is rigid and heavy.

With regard to armored vehicle cladding, the plating is thick and heavy, limiting its use. Greater protection is obtained by increasing the thickness of materials, such as steel. Some light vehicles cannot support such heavy armor and a compromise is deemed necessary.

Therefore, there is a continuing need for protective armor that is lightweight and versatile but that also provides a high degree of protection.

SUMMARY OF THE INVENTION

The present disclosure is directed to a resilient armor assembly comprising an armor panel, a base plate, and a resilient member disposed between the armor panel and the base plate. The resilient member has a spring coefficient sufficient to resiliently deform and prevent a projectile from rupturing and penetrating the armor assembly when the armor assembly is struck with a given impact load. The resilient member can include a plurality of discrete resilient members spaced apart variously over the armor panel. The resilient member can be a coil spring having a central axis that is oriented generally normal to the armor panel. The resilient member can include an elastomeric material.

In other embodiments, the present disclosure is directed to a resilient armor assembly having a base plate, a resilient member coupled to the base plate, and an armor panel coupled to the resilient member. The resilient member is positioned between the base plate and the armor panel, and the armor panel and the resilient member are configured to absorb energy from an incoming projectile or blast impact. The armor assembly further includes a guide member between the armor panel and base plate. The guide member permits movement of the armor panel toward the base plate in a direction generally normal to the armor panel and resists movement of the armor panel relative to the base plate in a direction generally parallel with a surface of the armor panel.

In yet other embodiments, the present disclosure is directed to An armor assembly including a base plate, an armor panel and means for resiliently absorbing an impact of a predetermined quantity. The means for resiliently absorbing the impact can be a spring or a solid resilient member or any other suitable equivalent structure and is positioned between the base plate and the armor panel with the base plate and armor panel being oriented generally parallel to one another. Impact incident on the armor panel or base plate will cause the means for resiliently absorbing impact to resiliently deflect in tension or compression. The armor panel, per unit surface area, weighs less than other armor panels made of materials comparable to the armor panel that are also capable of withstanding the impact. The armor assembly has a thickness defined between the armor panel and the base plate, and wherein the thickness of the armor assembly is comparable to a thickness of the other armor panels also capable of withstanding the impact.

BRIEF DESCRIPTION OF THE DRAWINGS

Preferred and alternative embodiments of the present invention are described in detail below with reference to the following drawings. These depict particular embodiments of the invention and are not intended to limit the scope of the invention as set forth in the claims. All of the drawings are schematics rather than precise representations and are not drawn to scale.

DETAILED DESCRIPTION OF THE PREFERRED EMBODIMENTS

Figure 1:
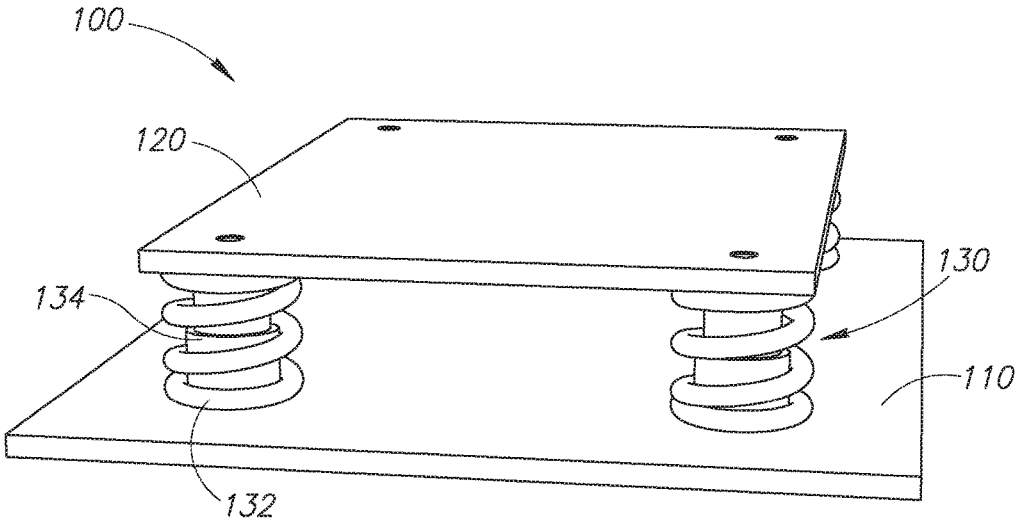
FIG. 1 is a perspective view of an armor assembly according to embodiments of the present disclosure.
Figure 2:
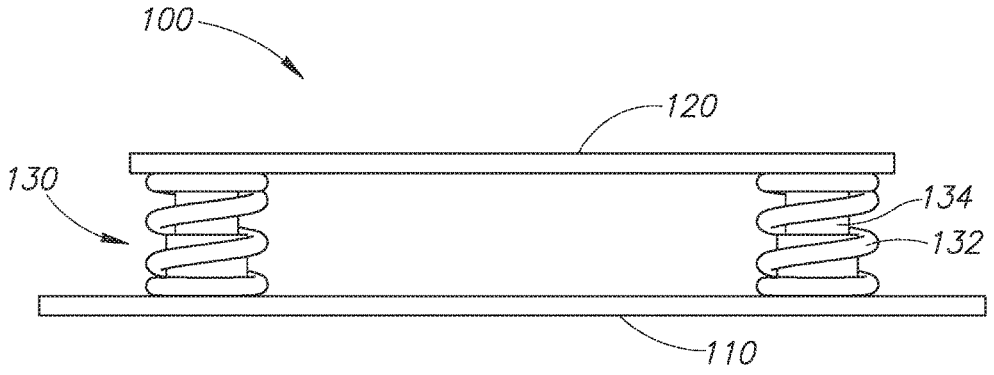
FIG. 2 is a side-elevational view of the armor assembly of FIG. 1 according to embodiments of the present disclosure.

FIG. 1 is a perspective view of a resiliently mounted armor panel assembly 100 according to embodiments of the present disclosure. The assembly 100 includes a base plate 110, an armor panel 120, and a plurality of resilient members 130 positioned between the armor panel 120 and the base plate 110. FIG. 2 is a side view of the assembly 100. The following discussion will refer to FIGS. 1 and 2 simultaneously. The assembly 100 can be used to protect buildings, installations, vehicles, or virtually any other structure. It can be sized and shaped according to the application, including use as body armor. Multiple panels may be used side by side. The base plate 110 can be part of the structure to which the resilient members 130 are coupled, or the base plate 110 can be part of the assembly 100 independent of the underlying structure. For example, the assembly 100 can be attached to an exterior surface of a vehicle, or the vehicle's hull can take the place of the base plate 110 with the resilient members 130 and armor panel 120 coupled to the hull. Alternatively, the base plate 110 may simply be a base framework. Preferably, the base plate 110 and armor panel 120 are made of an impact-resistant material such as a metal or a ceramic material used in conventional armor.

In some embodiments the individual resilient members 130 include a coil spring 132 and a guide member 134 positioned within the coil spring 132. The coil spring 132 can have a spring coefficient sufficient to absorb energy from an incoming projectile such as a bullet or a blast impact. The combined resiliency of the armor panel 120 and the resilient members 130 withstands the impact of the projectile or blast. A portion of the energy is absorbed by the armor panel 120, another portion is absorbed by the resilient members 130, and yet another portion of the energy can be absorbed by the base plate 110. In some embodiments the assembly 100 is designed such that, at a given impact load, the impact will be fully absorbed by the armor panel 120 and the resilient members 130. The resilient members 130 allow the assembly 100 to weigh less and still withstand a significant impact. Conversely, the assembly 100 can weigh the same as a conventional armor and yet withstand a greater impact due to the capability of absorbing energy through the resilient members 130.

FIGS. 1 and 2 show a basic assembly 100 where the base plate 110 and armor panel 120 are square and there are four resilient members 130 placed at the corners of the base plate 110 and armor panel 120. The placement, number, and dimensions of the base plate 110, armor panel 120, and resilient members 130 can vary as needed for a particular application. In some embodiments these parameters are at least partially determined by the expected impact load. For example, if the assembly 100 is to be used where it will take fire from a weapon firing .50 caliber rounds, which weigh approximately 661 grains and travel at approximately 2800 feet per second (muzzle velocity), the armor panel can be approximately 0.25 to 0.75 inches thick (depending on the projectile it is designed to absorb), the resilient members 130 can be approximately 1 to 12 inches tall (preferably between 2-6 inches tall), and can have a spring coefficient to absorb the expected load (potentially between 800 to 2000 pounds of force for a 50 caliber or like round). Longer springs would have lower spring rates. The spring rate selected would be the force of the targeted projectile for the application divided by the spring length available. The spacing between any two resilient members 130 can be between approximately 8 to 12 inches. These parameters can vary based on the impact type and load, and whether or not the base plate 110 is configured to resist any of the impact energy. The space between the resilient members 130 can be empty (with or without air) or can be filled with a material that may contribute to absorbing impact energy, or may simply insulate the space or provide heat shielding.

Figure 3D:
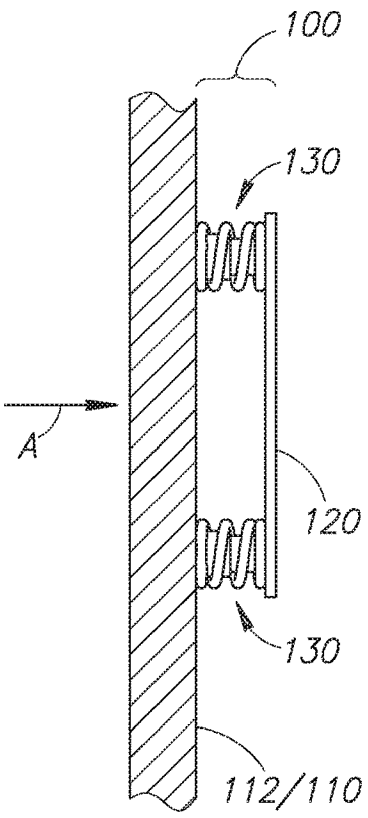
FIGS. 3A-3D are side schematic views of armor assemblies and associated structures according to embodiments of the present disclosure.
Figure 3C:
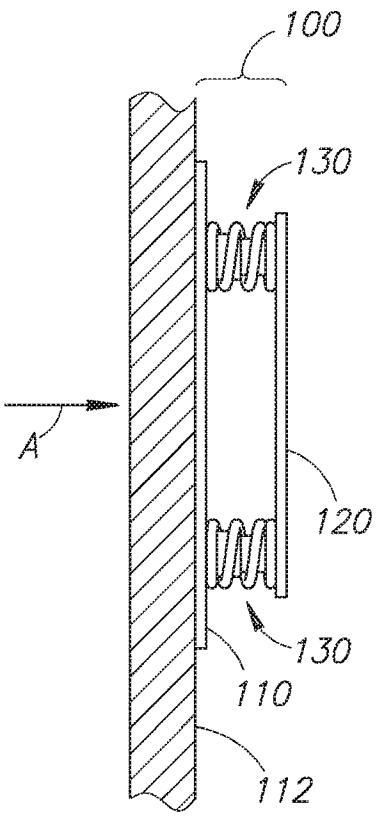
Figure 3B:
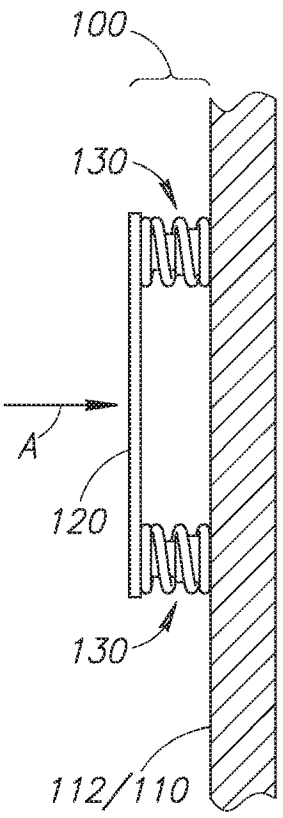
Figure 3A:
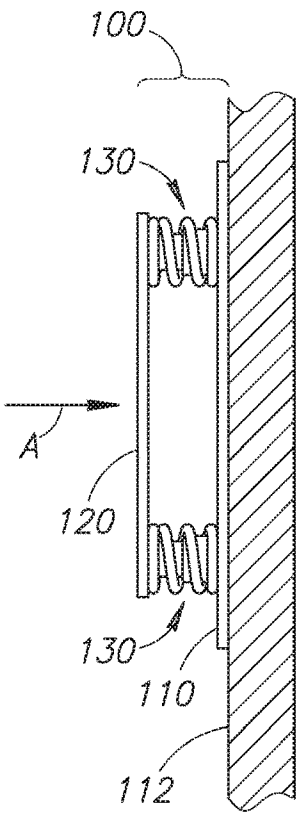

FIGS. 3A-3D are schematic side views of assemblies 100 of different orientations according to embodiments of the present disclosure. In each figure the impact approaches the assembly from the left-hand side as shown by the arrow A. In FIG. 3A the assembly 100 includes a base plate 110, armor panel 120, and resilient members 130 between the base plate 110 and armor panel 120. The assembly 100 is attached to a structure 112. In this configuration, the structure 112 is not necessarily intended to withstand a significant portion of the impact. All or nearly all the impact is intended to be taken up by the assembly 100 including the base plate 110. The impact will cause the armor panel 120 to deflect, deform, and even rupture. The resilient members 130 will compress, and the base plate 110 will deflect, deform, and even partially rupture. Assuming the impact load is exactly known, the minimum dimensions will allow the projectile to pass through the armor panel 120, deflect the resilient members 130, and become embedded within the base plate 110 without penetrating the base plate 110 with significant energy.

The embodiment shown in FIG. 3B is similar to that of FIG. 3A, although in this embodiment the base plate 110 is omitted and the resilient members 130 are coupled directly to the structure 112. In embodiments in which the structure 112 is not intended to or capable of withstanding a significant portion of the impact, the armor panel 120 and resilient members 130 can be designed to withstand an impact load without permitting the projectile to pass through the armor panel 120. Alternatively, where the structure 112 is sufficiently resilient to withstand a portion of the impact, the armor panel 120 and resilient members 130 can be designed such that the projectile deflects, deforms, and ruptures the armor panel 120, deflects the resilient members 130, and becomes embedded in the structure 112.

The embodiment depicted in FIG. 3C includes an assembly 100 including a base plate 110, resilient members 130, and an armor panel 120 on the opposite side of the structure. For example, if the structure 112 is a vehicle hull the assembly 100 is on the inside of the vehicle. As the impact reaches the armor panel 120 the resilient members 130 will be tensioned. Assuming the impact load is exactly known, the minimum dimensions will allow the projectile to deflect, deform, and rupture both the structure 112 and the base plate 110, tension the resilient members 130, and become embedded in the armor panel 120 without penetrating the armor panel 120 with significant energy. The structure 112 may or may not absorb a sufficient component of the impact energy, and the dimensions of the assembly components can be chosen accordingly. For a given impact load the dimensions of the assembly components may be smaller if the structure 112 itself absorbs a significant portion of the impact energy.

The embodiment shown in FIG. 3D is similar to that of FIG. 3C but the base plate 110 is omitted. The projectile will penetrate the structure 112, impact the armor panel 120, tension the resilient members 130, then deflect, deform, and become embedded in the armor panel 120. The coupling between the resilient members 130 and the structure 112 is preferably sufficiently strong to hold the assembly 100 to the structure 112 during the impact.

Figure 4A:
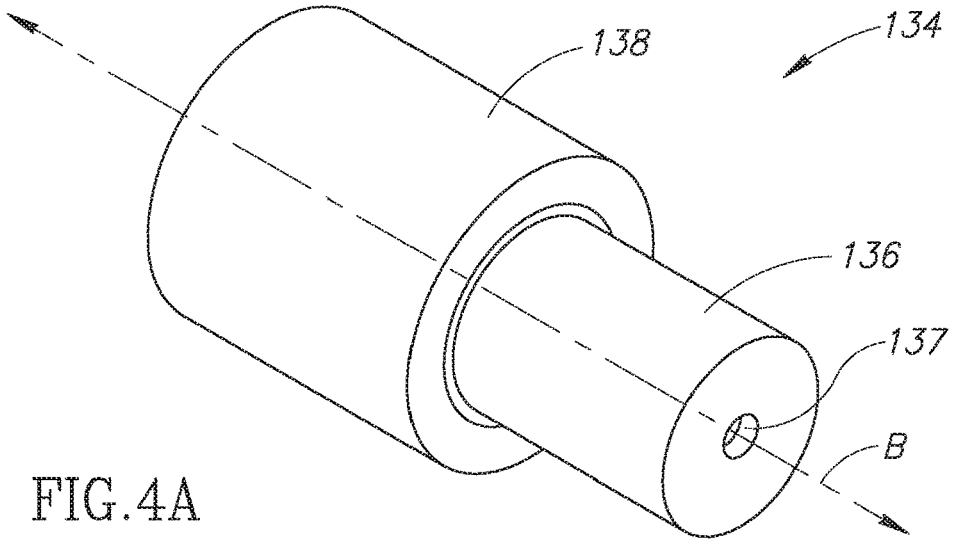
FIG. 4A is an isometric schematic view of a guide member for use with an armor assembly according to embodiments of the present disclosure.
Figure 4B:
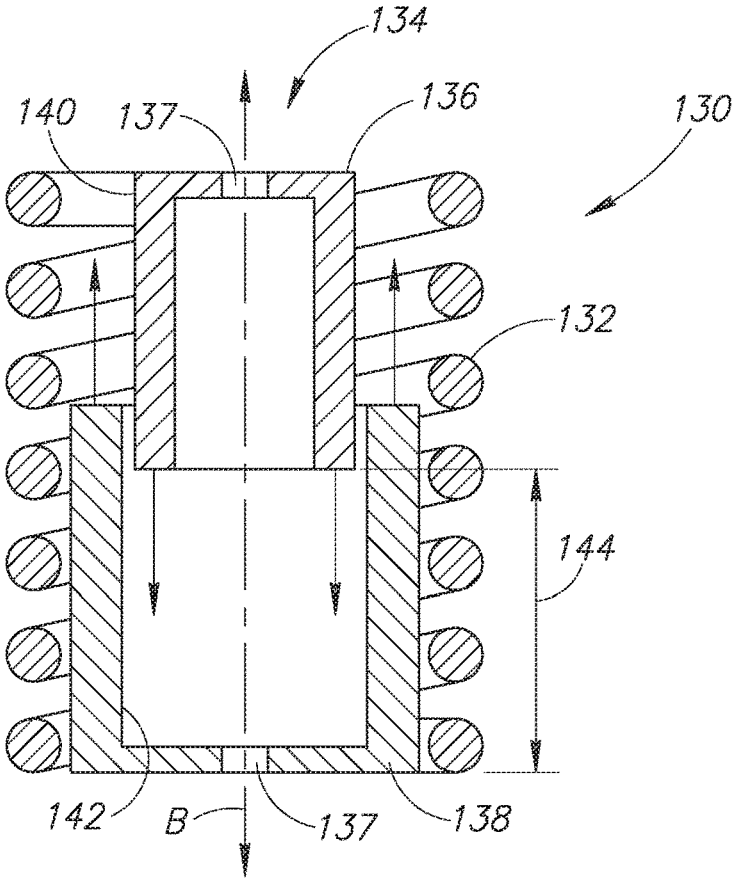
FIG. 4B is a cross-sectional view of the guide member and resilient member for the armor assembly according to embodiments of the present disclosure.

FIGS. 4A and 4B present an isometric and sectional elevational views of a guide member 134 and a cross-sectional view of the guide member 134 taken along line A-A of FIG. 2, respectively, according to embodiments of the present disclosure. The guide member 134 includes a first guide component 136 and a second guide component 138 that engage with one another and can move relative to one another along an axis B. At the end of the guide components is a flange or plate with a bolt hole 137 by which the guide components are fixed to the base plate 110 and armor panel 120. Any other suitable fixation mechanism can be used as well, such as an outwardly protruding flange with bolt holes or a threaded engagement between the guide members and the plates. For example, a bolt may be fixed to one of the plate and slidably engage the other plate with a bolt head or nut limiting the outer movement of the plate but allowing compression of the springs for the outer plate to move toward the base plate. In the embodiment shown, the first guide component 136 is a cylindrical shaft and the second guide component 138 is a hollow cylindrical shaft that receives the first guide component 136. In other embodiments, the two components can have any suitable complementary shape, such as a triangular, square, or oval-shaped profile and recess. Also, the second guide component 138 may simply be a recess or hole in the base plate 110 that receives the first guide component 136. The first guide component 136 has a mating surface 140 and the second guide component 138 has a mating surface 142 that can slide relative to one another and ensure that the armor plate 120 and base plate 110 move toward one another during impact.

When impacted, the guide member 134 deflects by a travel distance 144, which is determined by the dimensions of the guide member 134 and by the spring coefficient of the coil spring 132. In some embodiments, the spring coefficient is approximately 230 lbs/inch and the travel distance is approximately 1.3 inches. The travel distance can also be defined in proportion to other parameters of the assembly, such as the length of the resilient member 130 or the impact load.

Figure 5A:
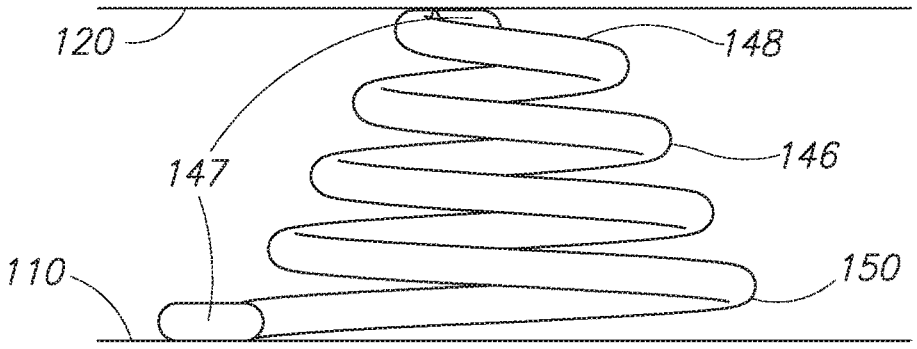
FIG. 5A is a side view of a conical coil spring according to embodiments of the present disclosure.
Figure 5B:
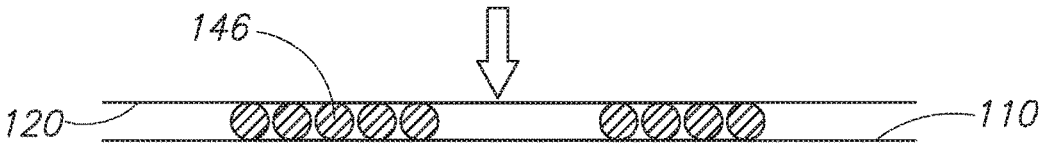
FIG. 5B is a side view of the conical coil spring in a compressed state according to embodiments of the present disclosure.
Figure 5C:
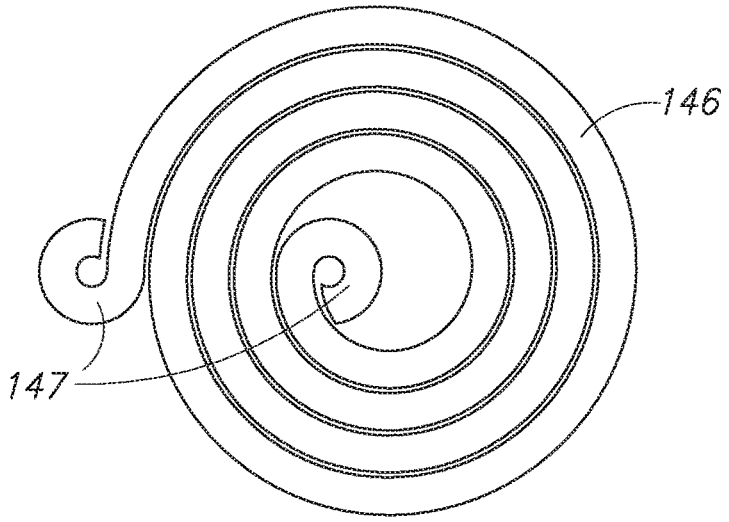
FIG. 5C is a top view of the conical coil spring of FIGS. 5A and 5B according to embodiments of the present disclosure.

FIG. 5A shows a coil spring 146 according to embodiments of the present disclosure. The coil spring 146 has a conical shape with a narrow end 148 and a broad end 150. The spring 146 can be inverted with the narrow end 148 against the base plate 110. FIG. 5B shows the coil spring 146 in a compressed state. The conical shape of the coil spring 146 permits the spring to deflect down to a thickness substantially equal to the wire thickness. The pitch of the coils and the slope of the cone can be determined in such a way to permit the spring to compress fully. FIG. 5C is a top view of the coil spring 146. The coil spring 146 has an outer end and an inner end which can be pinned or otherwise fastened to the base plate 110 and armor panel 120, respectively, to maintain the spring 146 in position. The coil spring 146 can have loops 147 at one or both ends by which to secure the coil spring 146 to the base plate 110 and armor panel 120. Alternatively, the coil spring 146 can be used with a guide member as shown in FIGS. 4A and 4B in which case the guide member can be cylindrical and sized to fit within the narrowest portion of the spring 146.

Figure 6:
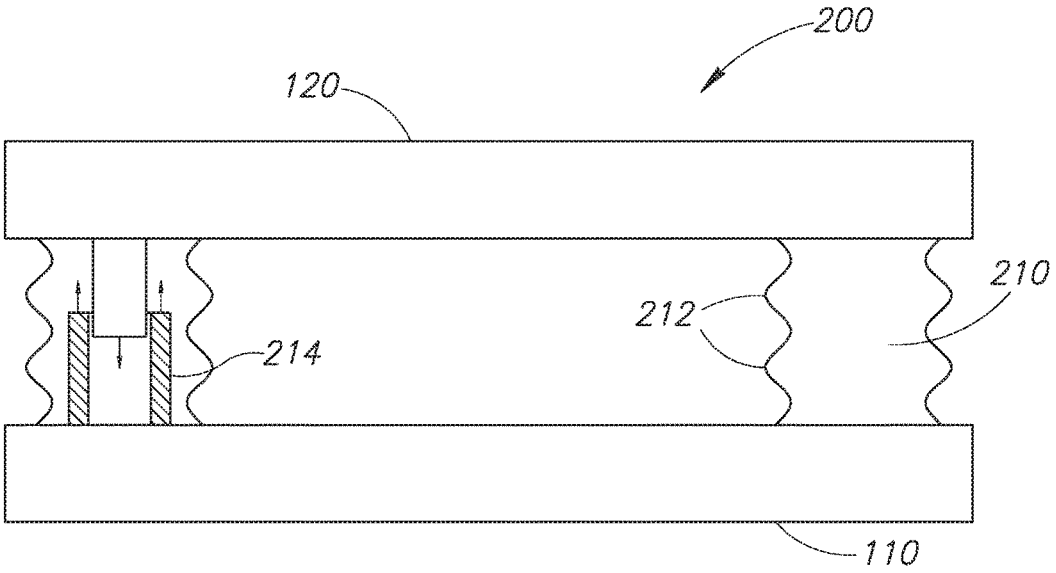
FIG. 6 is a side schematic view of an armor assembly according to embodiments of the present disclosure.

FIG. 6 is a side view of another armor assembly 200 embodiment of the present disclosure including an armor panel 120 and a base plate 110. The assembly 200 includes a solid resilient member 210, such as an elastomeric member, positioned between the armor panel 120 and the base plate 110. The solid resilient member 210 can be a generally cylindrical member with a grooved outer surface 212 that has a desired spring coefficient. The spring coefficient of the solid resilient member 210 can be substantially the same as that achieved by other embodiments discussed above featuring a coil spring. The material, dimensions, number, and placement of the solid resilient members 210 can vary to achieve an overall spring coefficient within a desired range for an expected impact load. The solid resilient member 210 can include a guide member 214 embedded within, adjacent to, or spaced apart from the solid resilient member 210 to guide the movement of the armor panel 120 toward and away from the base plate 110. The guide member 214 can be generally similar to the guide member 134 described above with reference to FIGS. 4A and 4B.

Figure 7:
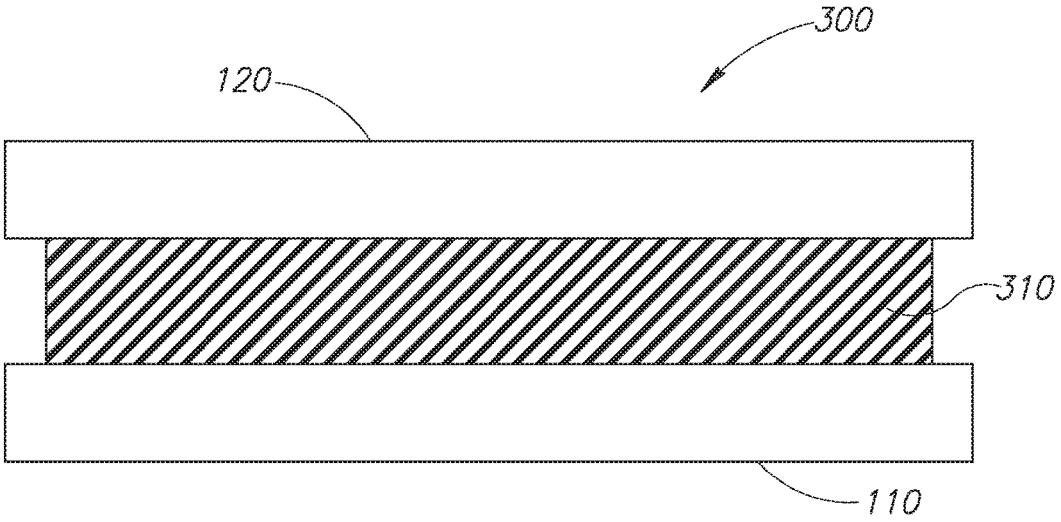
FIG. 7 is a side schematic view of an armor assembly according to embodiments of the present disclosure.

FIG. 7 is a side view of yet another armor assembly 300 according to embodiments of the present disclosure including an armor panel 120, a base plate 110, and a substantially solid layer 310 of resilient material between the armor panel 120 and the base plate 100. The solid layer 310 can be made of any suitable material, including metal, elastomer, ceramic, or any other suitable energy-dissipating or energy-absorbing material. Regardless of the material, the solid layer 310 has a spring coefficient within a desired range to absorb impact energy resiliently. The assembly 300 can also include resilient members embedded within the solid layer 310, such as the resilient members 210 shown in FIG. 6 or the resilient members 130 shown above in FIGS. 1-5. As with the other embodiments, the number, size, and positioning of the resilient members within the solid layer 310 can vary as needed to achieve a desired spring coefficient for a given expected impact load. In general, more and larger resilient members increases the spring coefficient while fewer and smaller resilient members lowers the spring constant.

The armor assemblies disclosed herein achieve a desired level of protection at a significantly lower weight threshold. Alternatively, for a given weight limit, the armor assemblies of the present disclosure offer a greater degree of protection from impact blasts and other threats.

It should be understood that the present disclosure is not limited to the embodiments disclosed herein as such embodiments may vary somewhat. It is also to be understood that the terminology employed herein is used for the purpose of describing particular embodiments only and is not intended to be limiting in scope and that limitations are only provided by the appended claims and equivalents thereof.

What is claimed is:

1. A resilient armor assembly, comprising:

an armor panel;

a base;

a resilient member disposed between the armor panel and the base, wherein the resilient member has a spring coefficient sufficiently high to resiliently deform and absorb energy from a projectile or blast, and wherein the armor panel is free to move toward and away from the base as the resilient member compresses and expands; and wherein the resilient member comprises a coil spring and an elastomeric material, the elastomeric material being disposed at least within the coil spring, the coil spring defining a central axis, wherein the resilient member further comprises a guide member positioned within the coil spring, the guide member having a surface that extends along a direction parallel to the central axis of the spring, the elastomeric material contacting the surface of the guide member.

2. The resilient armor assembly of claim 1 wherein the resilient member comprises a plurality of discrete resilient members spaced apart over the armor panel.

3. The resilient armor assembly of claim 1 wherein the central axis of the coil spring is oriented generally normal to the armor panel.

4. The resilient armor assembly of claim 1, wherein the guide member is configured to permit the spring to move axially along the central axis.

5. The resilient armor assembly of claim 1 wherein the coil spring has a conical shape.

6. The resilient armor assembly of claim 5 wherein the thickness and pitch of the coil spring permits the spring to deform to a height substantially equal to the thickness of the wire.

7. The resilient armor assembly of claim 1 wherein the base plate comprises part of an installation or vehicle to which the armor panel is coupled.

8. The resilient armor assembly of claim 1 wherein the armor panel is nearer to a source of an expected impact or projectile than the base, such that the impact or projectile reaches the armor panel before reaching the resilient member or the base.

9. The resilient armor assembly of claim 1 wherein the base includes a base plate, and wherein the base plate is nearer to a source of an expected impact or projectile than the resilient member or the armor panel such that the impact or projectile would contact the base plate before contacting the resilient member or the armor panel.

10. The resilient armor assembly of claim 1 wherein the resilient member is made from one or more of urethane foam, silicone, steel, stainless steel, titanium, carbon fiber, ceramic, urethane, fiberglass.

11. The resilient armor assembly of claim 1 wherein the armor panel and base plate are made of ceramic reinforced carbon fiber, ceramic composite, carbon fiber, fiberglass, para-aramid fibers, aramid fibers, steel, stainless steel, a composite grid, and stainless and aluminum alloys.

12. The resilient armor assembly of claim 1, wherein the guide member has a first guide component and a second guide component, wherein the first guide component is coupled to the armor panel and the second guide component is coupled to the base plate, and wherein the first and second guide component engage together to permit the armor panel and base plate to move toward and away from one another along an axis generally normal to the surface of the armor panel and base plate.

13. The resilient armor assembly of claim 12 wherein the first guide component is a cylindrical shaft and the second guide component is a hollow cylindrical shaft configured to receive the first guide component.

14. The resilient armor assembly of claim 12 wherein the coil spring encircles the guide member.

15. The resilient armor assembly of claim 1 wherein the resilient member has a spring coefficient of approximately between 50 and 800 pounds per inch.

16. The resilient armor assembly of claim 1 wherein the resilient member covers between about 10-50% of the surface area for a given portion of the armor panel.

17. A resilient armor assembly comprising:

a base plate;

a resilient member coupled to the base plate, the resilient member comprising a spring and an elastomer, the elastomer being disposed at least within the spring;

an armor panel coupled to the resilient member, wherein the resilient member is positioned between the base plate and the armor panel, wherein the armor panel and the resilient member are configured to absorb energy from an incoming projectile or blast impact; and a guide member between the armor panel and base plate, wherein the guide member permits movement of the armor panel toward the base plate in a direction generally normal to the armor panel and resists movement of the armor panel relative to the base plate in a direction generally parallel with a surface of the armor panel, wherein the spring defines a central axis, the guide member being positioned within the spring and having a surface that extends along a direction parallel to the central axis of the spring, the elastomeric material contacting the surface of the guide member.

18. The resilient armor assembly of claim 17 wherein the spring comprises a coil spring.

19. The resilient armor assembly of claim 18, wherein the guide member is positioned concentrically with the coil spring.

20. The resilient armor assembly of claim 17 wherein the armor panel is positioned nearer to a source of the incoming projectile or blast impact than the resilient member, such that the incoming projectile or blast impact energy would contact the armor panel and cause the resilient member to compress.

21. The resilient armor assembly of claim 17 wherein the base plate is positioned nearer to a source of the incoming projectile or blast impact than the armor panel, such that the incoming projectile or blast impact, after penetrating the base plate, impacts the armor panel and causes the resilient member to tension.

22. The resilient armor assembly of claim 17 wherein the resilient member has a spring coefficient of approximately between 50 and 800 pounds per inch.

23. A resilient armor assembly, comprising:

an armor panel;

a base;

a resilient member disposed between the armor panel and the base, wherein the resilient member has a spring coefficient sufficiently high to resiliently deform and absorb energy from a projectile or blast, and wherein the armor panel is free to move toward and away from the base as the resilient member compresses and expands; and wherein the resilient member comprises both a coil spring and an elastomeric material together, the elastomeric material being disposed at least within the coil spring, the coil spring defining a central axis, wherein the resilient member further comprises a guide member positioned within the coil spring, the guide member having a surface that extends along a direction parallel to the central axis of the spring, the elastomeric material contacting the surface of the guide member.

24. The resilient armor assembly of claim 23, wherein the elastomeric material comprises a cylindrical member.

25. The resilient armor assembly of claim 24, wherein the elastomeric material comprises a cylindrical member with a grooved outer surface.

26. The resilient armor assembly of claim 23, wherein the elastomeric material comprises a solid layer extending between the armor panel and the base such that both of the solid layer and the coil spring connect to both of the armor panel and the base.

27. The resilient armor assembly of claim 26, wherein the coil spring is embedded within the solid layer.

* * * * *